US011724206B2

(12) United States Patent
Gao

(10) Patent No.: US 11,724,206 B2
(45) Date of Patent: Aug. 15, 2023

(54) INFLATABLE WATER SLIDE HAVING AIR BUBBLE BLOWING FUNCTION

(71) Applicant: SWIFTECH COMPANY LTD., Zhongshan (CN)

(72) Inventor: Xiang Gao, Zhongshan (CN)

(73) Assignee: SWIFTECH COMPANY LTD., Zhongshan (CN)

( * ) Notice: Subject to any disclaimer, the term of this patent is extended or adjusted under 35 U.S.C. 154(b) by 250 days.

(21) Appl. No.: 17/610,696

(22) PCT Filed: Jan. 22, 2019

(86) PCT No.: PCT/CN2019/072601
§ 371 (c)(1),
(2) Date: Nov. 11, 2021

(87) PCT Pub. No.: WO2020/118870
PCT Pub. Date: Jun. 18, 2020

(65) Prior Publication Data

US 2022/0297017 A1 Sep. 22, 2022

(30) Foreign Application Priority Data

Dec. 14, 2018 (CN) ..... 201822102632.5

(51) Int. Cl.
*A63G 21/18* (2006.01)
*A63H 33/28* (2006.01)

(52) U.S. Cl.
CPC ..... *A63G 21/18* (2013.01); *A63H 33/28* (2013.01)

(58) Field of Classification Search
CPC ..... A63G 21/00; A63G 21/18; A63G 31/00; A63G 31/007; A63H 33/28
USPC ..... 472/117, 128; 446/15–21
See application file for complete search history.

(56) References Cited

U.S. PATENT DOCUMENTS 4,787,875 A * 11/1988 Baron ..... A63H 33/28 239/289
6,261,186 B1 * 7/2001 Henry ..... A63G 31/007 239/16
6,482,096 B1 * 11/2002 Rieber ..... A63G 9/00 472/125

(Continued)

*Primary Examiner* — Kien T Nguyen
(74) *Attorney, Agent, or Firm* — Matthias Scholl P.C.; Matthias Scholl

(57) ABSTRACT

An inflatable water slide having an air bubble blowing function, comprising a slide starting platform air sac body (11), a slope climbing air sac body (12), and a slide air sac body (13). Any or all of the slide start air sac body (11), the slope climbing air sac body (12), and the slide air sac body (13) are provided thereon with a bubble blowing apparatus (2). The bubble blowing apparatus (2) comprises an airduct cavity (21), a liquid storage compartment (22) used for storing a bubbling liquid, and a bubble discharging plate (23) provided with a bubble discharging opening. The bubble discharging plate (23) is provided at an outlet of the airduct cavity (21). The liquid storage compartment (22) is provided above the bubble discharging plate (23) and is provided with a liquid outlet connected to the bubble discharging plate (23). The airduct cavity (21) is in communication with cavities of the slide starting platform air sac body (11), the slope climbing air sac body (12), and the slide air sac body (13) provided corresponding to the bubble blowing apparatus (2).

4 Claims, 1 Drawing Sheet

(56) References Cited

U.S. PATENT DOCUMENTS

| | | | | |
|---|---|---|---|---|
| 2007/0167246 | A1* | 7/2007 | McKee | A63G 21/00 472/116 |
| 2008/0312003 | A1* | 12/2008 | Bogar | A63G 21/18 472/117 |
| 2009/0137330 | A1* | 5/2009 | Sefchick | A63G 31/007 472/117 |
| 2015/0158040 | A1* | 6/2015 | Ballard | B05B 7/0018 239/8 |

* cited by examiner

INFLATABLE WATER SLIDE HAVING AIR BUBBLE BLOWING FUNCTION

CROSS-REFERENCE TO RELATED APPLICATIONS

This application is a National Stage Appl. filed under 35 USC 371 of International Patent Application No. PCT/CN2019/072601 with an international filing date of Jan. 22, 2019, designating the United States, and further claims foreign priority benefits to Chinese Patent Application No. 201822102632.5 filed Dec. 14, 2018.

TECHNICAL FIELD

The disclosure relates to an inflatable water slide possessing the function of air blowing bubbles.

BACKGROUND

Current inflatable amusement products are usually devices composed of elastic fibers. The devices, when continuously inflated by a fan, expand and hold their shape dependent on the gas's pressure. Using the inflatable devices allows for participants to bounce, climb, slide, wrestle on the particular areas, and move through a tunnel.

Bubble machines are popular types of toys for kids. Currently, most of the bubble machines are referred to as bubble blowers, usually including electric bubble blowers that automatically blows out bubble, and conventional bubble blowers that are blown with the mouth. The bubble blowers make bubbles by blowing on a membrane of soap water stuck to a hoop.

In general, the kids are not allowed to bring the bubble blowers onto the inflatable amusement devices because of safety concerns. The current products in present markets cannot meet demand for kids who are allowed to play with inflatable amusement products and bubble machines at the same time.

SUMMARY

The disclosure provides an inflatable water slide, which possesses a simple structure and the function of making bubbles by blowing air into soapy water.

To achieve the purpose, the following technical solutions are adopted.

The inflatable water slide comprises a horizontal inflatable section, a first inflatable section tilted with respect to the horizontal inflatable section, and a second inflatable section tilted with respect to the horizontal inflatable section and communicating with the first inflatable section; the horizontal inflatable section, the first inflatable section, and the second each comprise an inner cavity. At least one of the horizontal inflatable section, the first inflatable section, and the second inflatable section is equipped with a bubble blower. The disclosure just illustrates the installation of the bubble blower on the horizontal inflatable section. The installation of the bubble blower on the first inflatable section and/or the second inflatable section is the same as that disposed on the horizontal inflatable section. The bubble blower comprises an air duct, a fluid reservoir comprising a fluid outlet, and a bubble disc with a plurality of through holes; the bubble disc is disposed at the outlet of the air duct; the fluid reservoir is disposed on the bubble disc and the fluid outlet communicates with the bubble disc; the air duct communicates with the inner cavity of at least one of the horizontal inflatable section, the first inflatable section, and the second inflatable section where the bubble blower is disposed.

The inflatable water slide offers advantages in simple structure, and offers children the opportunity to play water, at the same time, play with bubbles formed by the installed bubble blowers.

As an improvement, the following technical solutions are adopted.

The inflatable water slide further comprises a blower disposed in the inner cavity of at least one of the inflatable sections. The blower pumps air continuously into the inflatable sections, providing a constant air pressure in the inflatable sections.

The bubble disc comprises porous cloth.

The bubble disc comprises plastic and a plurality of blades. Each of the plurality of blades has a through hole, so bubbles may be formed when the air passes through the through hole. Each of the plurality of blades further comprises a convex or groove structure back to the air duct; such a design guides the soapy water flow from the liquid reservoir, increases the number of bubbles, and improves the quality of bubbles.

In use, the pressure in the inner cavity of the inflatable sections increases when participants crawl, walk or bounce on the inflatable water slide. The change in the pressure creates wind. The wind blows into the bubbles blower and blows on the membrane of sop water stuck to the bubble disc to cause it to grow into bubbles.

DETAILED DESCRIPTION

Figure 1:
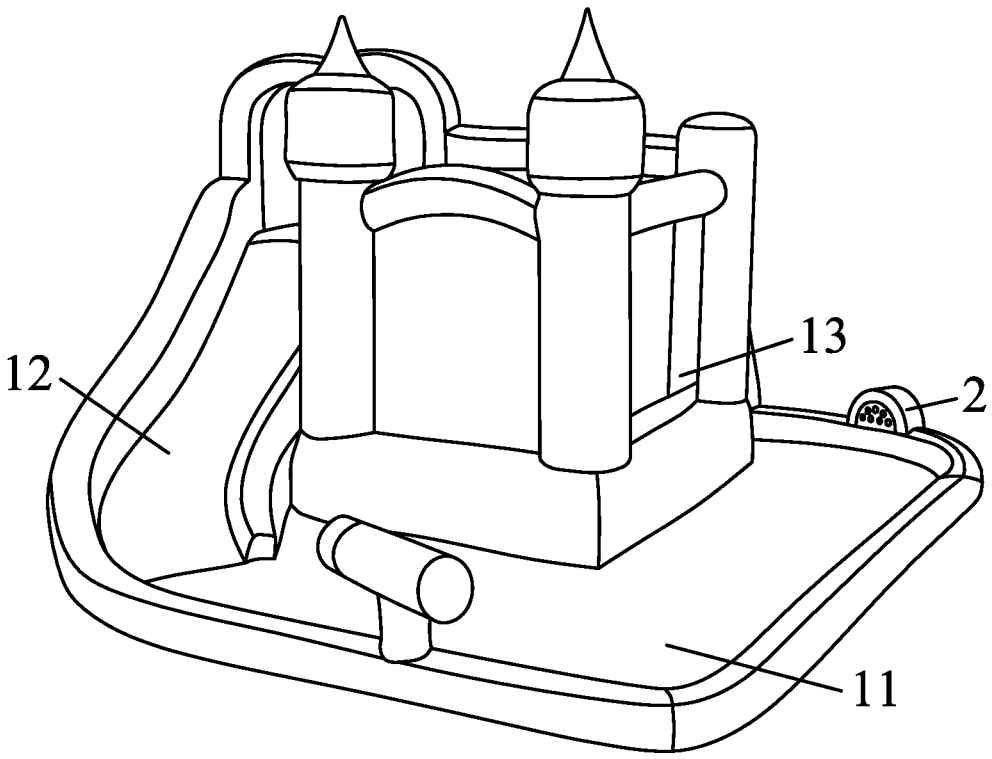
FIG. 1 is a schematic diagram of a three-dimensional structure of an inflatable water slide according to the embodiment of the disclosure.
Figure 2:
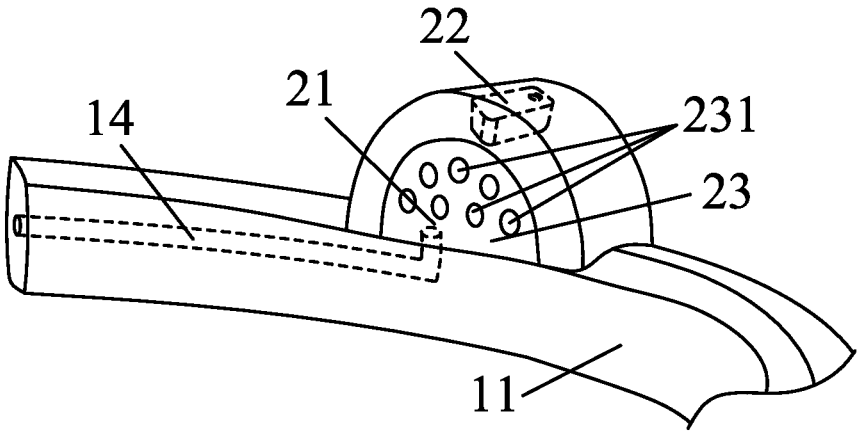
FIG. 2 is a schematic diagram of a three-dimensional structure of a bubble blower according to the embodiment of the disclosure.

Referring to FIGS. 1 and 2, an inflatable water slide comprises a horizontal inflatable section 11, a first inflatable section 12 tilted with respect to the horizontal inflatable section, and a second inflatable section 13 tilted with respect to the horizontal inflatable section and communicating with the first inflatable section; the horizontal inflatable section, the first inflatable section, and the second each comprise an inner cavity. At least one inflatable section is equipped with a bubble blower 2. The inflatable water slide further comprises a blower (not shown in the figures) disposed in the inner cavity 14 of at least one of the inflatable sections. The blower pumps air continuously into the inflatable sections, providing a constant air pressure in the inflatable sections.

The bubble blower 2 comprises an air duct 21, a fluid reservoir 22 comprising a fluid outlet, and a bubble disc 23 with a plurality of through holes 231. The bubble disc 23 is disposed at the outlet of the air duct 21. The fluid reservoir 22 is disposed on the bubble disc 23 and the fluid outlet communicates with the bubble disc. The air duct 21 communicates with the inner cavity of at least one of the horizontal inflatable section, the first inflatable section, and the second inflatable section where the bubble blower is disposed.

The bubble disc 23 comprises porous cloth.

The bubble disc 23 comprises plastic and a plurality of blades. Each of the plurality of blades comprises a through hole 231, so bubbles may be formed when air passes through the through hole. Each of the plurality of blades further comprises a convex or groove structure back to the air duct 21, such a design guides the soapy water flow from the liquid reservoir 22, increases the number of bubbles, and improves the quality of bubbles. Since the bubble disc 23 described herein refers to a common disc structure of the bubble blowers in the present market, it is not detailed in the description.

In use, the pressure in the inner cavity of the horizontal inflatable section 11, the first inflatable section 12 and the second inflatable section 13 increases when participants crawl, walk or bounce on the inflatable water slide. The change in the pressure creates wind. The wind blows into the bubble blower 2 and blows on the membrane of soap water stuck to the bubble disc to cause it to grow into bubbles.

The invention claimed is:

1. An inflatable water slide, comprising a horizontal inflatable section, a first inflatable section tilted with respect to the horizontal inflatable section, and a second inflatable section tilted with respect to the horizontal inflatable section and communicating with the first inflatable section;

wherein:

at least one of the horizontal inflatable section, the first inflatable section, and the second inflatable section is equipped with a bubble blower;

the bubble blower comprises an air duct, a fluid reservoir comprising a fluid outlet, and a bubble disc with a plurality of through holes; the bubble disc is disposed at an outlet of the air duct; the fluid reservoir is disposed on the bubble disc and the fluid outlet communicates with the bubble disc; the horizontal inflatable section, the first inflatable section, and the second inflatable section each comprise an inner cavity; and the air duct communicates with the inner cavity of at least one of the horizontal inflatable section, the first inflatable section, and the second inflatable section where the bubble blower is disposed.

2. The inflatable water slide of claim 1, further comprising a blower disposed in the inner cavity of at least one of the horizontal inflatable section, the first inflatable section, and the second inflatable section where the bubble blower is disposed.

3. The inflatable water slide of claim 1 or 2, wherein the bubble disc comprises porous cloth.

4. The inflatable water slide of claim 1 or 2, wherein the bubble disc comprises plastic and a plurality of blades; each of the plurality of blades has a through hole; each of the plurality of blades further comprises a convex or groove structure back to the air duct.

* * * * *